US009447669B2

(12) United States Patent
Levitov et al.

(10) Patent No.: US 9,447,669 B2
(45) Date of Patent: Sep. 20, 2016

(54) PULSED ACOUSTIC IMPACT FOR FACILITATION OF OIL AND GAS EXTRACTING

(71) Applicants: Yevgeny B. Levitov, San Antonio, TX (US); Ernest Orentlikherman, Moscow (RU); Isaak Orentlikherman, Moscow (RU)

(72) Inventors: Yevgeny B. Levitov, San Antonio, TX (US); Ernest Orentlikherman, Moscow (RU); Isaak Orentlikherman, Moscow (RU)

( * ) Notice: Subject to any disclaimer, the term of this patent is extended or adjusted under 35 U.S.C. 154(b) by 0 days.

(21) Appl. No.: 14/953,151

(22) Filed: Nov. 27, 2015

(65) Prior Publication Data

US 2016/0130926 A1 May 12, 2016

Related U.S. Application Data

(63) Continuation-in-part of application No. 14/508,081, filed on Oct. 7, 2014, now Pat. No. 9,228,419, which is a continuation-in-part of application No. 14/218,533, filed on Mar. 18, 2014, now Pat. No. 8,881,807.

(60) Provisional application No. 61/802,846, filed on Mar. 18, 2013.

(51) Int. Cl.

| | |
|---|---|
| ***E21B 28/00*** | (2006.01) |
| ***E21B 43/25*** | (2006.01) |
| ***E21B 47/00*** | (2012.01) |
| ***E21B 49/00*** | (2006.01) |
| ***E21B 49/08*** | (2006.01) |
| ***E21B 47/06*** | (2012.01) |
| *E21B 43/00* | (2006.01) |

(52) U.S. Cl.

CPC ..... *E21B 43/25* (2013.01); *E21B 47/00* (2013.01); *E21B 47/06* (2013.01); *E21B 47/065* (2013.01); *E21B 49/00* (2013.01); *E21B 49/08* (2013.01); *E21B 43/003* (2013.01); *E21B 2049/085* (2013.01)

(58) Field of Classification Search

CPC ..... E21B 28/00; E21B 43/003; E21B 43/17
USPC ..... 166/177.1, 177.2, 177.6, 311, 249
See application file for complete search history.

(56) References Cited

U.S. PATENT DOCUMENTS

| | | | | |
|---|---|---|---|---|
| 5,595,243 | A * | 1/1997 | Maki, Jr. | B08B 3/12 166/177.2 |
| 6,227,293 | B1 * | 5/2001 | Huffman | E21B 28/00 166/177.2 |
| 7,318,471 | B2 * | 1/2008 | Rodney | E21B 37/08 166/177.2 |
| 7,628,202 | B2 * | 12/2009 | Meyer | G01V 1/02 166/177.2 |
| 8,881,807 | B1 * | 11/2014 | Orentlikherman | E21B 28/00 166/177.2 |
| 9,004,165 | B2 * | 4/2015 | Abramova | E21B 43/003 166/177.1 |
| 9,228,419 | B1 * | 1/2016 | Orentlikherman | E21B 43/003 |
| 2012/0132416 | A1 * | 5/2012 | Zolezzi-Garreton | E21B 43/003 166/249 |

* cited by examiner

*Primary Examiner* — Kenneth L Thompson
(74) *Attorney, Agent, or Firm* — Nadya Reingand

(57) ABSTRACT

A method for improving and maintaining well productivity is disclosed. The method comprises placing acoustic devices within wells of a geological formation, measuring parameters for initial pulsed acoustic impact, and continuing to measure parameters in order to change impact parameters during production to optimize the acoustic effect. The method may be used to restore, maintain, or increase the productivity of an entire geological formation (oil or gas), and to reduce the water cut in the formation.

20 Claims, 5 Drawing Sheets

PULSED ACOUSTIC IMPACT FOR FACILITATION OF OIL AND GAS EXTRACTING

CROSS-REFERENCE TO RELATED APPLICATIONS

This patent application is a Continuation-in-Part of U.S. patent application Ser. No. 14/508,081 filed on Oct. 7, 2014, which is a Continuation-in-part of U.S. patent application Ser. No. 14/218,533 filed on Mar. 18, 2014, now U.S. Pat. No. 8,881,807, claiming priority to U.S. provisional application No. 61/802,846 filed on Mar. 18, 2013; all of them incorporated herein by reference in their entirety.

FIELD OF THE INVENTION

This invention relates to the oil and gas industry and the optimization of oil and gas recovery rates from a geological formation, resulting in increased oil and gas recoverable reserves, stable, increased oil production, and reduced water cut.

BACKGROUND OF THE INVENTION

Currently, there exist several different methods for impacting a formation to facilitate the production processes of oil and gas, including several chemical methods, which are the methods most widely used.

Currently used methods, however, have a host of disadvantages, including but not limited to the following:

1. Low impact selectivity. For example, insulation procedures on a washed formation can lead to the sealing of effectively working sub-layers.
2. Shallow reagent penetration depth into a formation.
3. Significant adsorption of many reagents, for example SAS, leading to unnecessarily high reagent losses and increased costs.
4. Increased environmental risks.
5. High overall cost.

The closest analog to the proposed invention is RF Patent No. 2143554, entitled "Acoustic method for impacting a well", which includes treating the well using an acoustic field with the goal of restoring filtration ability in the bottom zone. The process, however, only applies to one well, improving productivity in only one area.

In general, during oil (or gas) field maintenance, water delivery may be used through the system to support stratum pressure. A problem associated with such systems is muddling of the bottom hole zone, which lowers injected water volume and disregulates efficient water delivery into the formation. There exists a need to clean and keep the bottom hole zone from muddling, to restore fluid conductivity of well systems, and to increase well injectivity. There also exists a need for improving the productivity of more than one area of a well field or formation, or the field or formation in its entirety. The present invention addresses these needs.

SUMMARY OF THE INVENTION

The present invention discloses a method for restoring, maintaining, and/or increasing the productivity of a geological formation (oil or gas) or reducing a water cut in that formation. The method comprises: positioning an acoustic in a well and performing an acoustic treatment impacting a muddled zone in cycles by a series of acoustic packets thus periodically applying acoustic/ultrasonic pressure on the muddled zone and then dropping it off to zero. A cycle time CT consists of a pressure time PT and a relaxation time RT, and a ratio PT:RT is selected depending on formation parameters obtained by sensors positioned on the acoustic device.

In some aspects, the method comprises using a wireless acoustic device. In other aspects, the acoustic device may be wired or any other known type.

In some aspects, the parameters include concentration and composition of salts, sulphur, wax, tar, asphalt; porosity (%), initial and current permeability ($\alpha$) of the formation; density and viscosity of a fluid in the well; a formation temperature and static and dynamic pressures in a collector zone.

The most preferable frequency ranges for the treatment are the following: (1) a cycle frequency FL1 is in the range from 0.5 Hz to 4 Hz with a packet frequency FH1 in the range from 4 kHz to 7kHz; (2) a cycle frequency FL2 is in the range from 4 Hz to 10 Hz with a packet frequency FH2 in the range from 7 kHz to 14 kHz; and (3) a cycle frequency FL3 is in the range from 14 kHz to 18 kHz with a packet frequency FH3 in the range from 10 Hz to 100 Hz. In one embodiment the treatment frequency (either cycle frequency or packet frequency) is selected to achieve a resonant oscillation in a perforated well zone.

Emission power varies from 0 to 5 kW or greater and depends on the condition of the well and bottom hole zone. In one embodiment, the emission power varies during the treatment with the same cycle frequency.

Growth of a packet front occurs along an exponential or other growth curve to prevent a water hammer, which can lead not to the structural breakdown of contamination, but to flattening of the front wall of the muddled layer.

The acoustic device operation includes a feedback. The treatment parameters are changed based on the changing of data received from the sensors placed on the device. The treatment parameters adjustment is performed by a microcontroller installed on the device. Alternatively, the control can be performed remotely.

DETAILED DESCRIPTION OF THE PREFERRED EMBODIMENT

The claimed method comprises emitting complex acoustic vibrations on the perforated zones of a well, at specific interlayers of a well, and/or on the filters in horizontal wells. The perforated interval and productive strata of the reservoir are thus sequentially and specifically treated with a directed acoustic field. The pressure, time, and range of the acoustics are correlated and applied in various combinations depending on detected characteristics of the specific well and the formation within the well. Signals in the audible and ultrasound ranges, with 360 degree directional characteristics (i.e. in all directions), provide acoustic pressures from a minimum value, necessary to cause changes in an active production well, to a maximum value, which is limited by the elasticity and other characteristics of the formation. The duration of the exposure is based on the effective exposure time, which also depends on characteristics of the individual well and the formation within it. The acoustic effect has an effective exposure range starting from 0.05 meters and is limited only by the geological characteristics of the formation. Acoustic effects can be created in a basic mode—with sequential processing of the wellbore production strata interval using three acoustic signals.

The present invention improves upon the prior art by performing acoustic treatment in a well or well system by a series of pulses.

Figure 1:
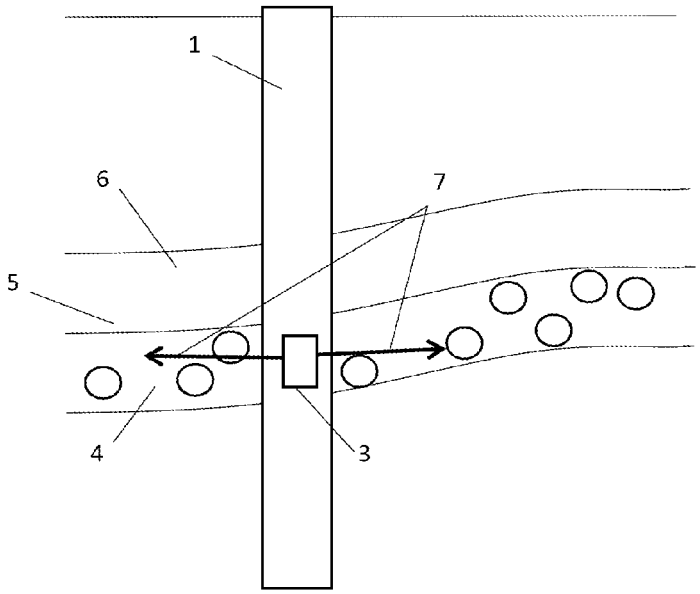
FIG. 1 shows a side cross-sectional view of one embodiment of the present invention, where an acoustic device is placed within a well.

FIG. 1 shows acoustic device 3 is positioned within a particular well 1. The acoustic device 3 is positioned at or nearby the water layer 4, such that the acoustic processing creates an impact on the water layer to increase the water injection rate 7. The water layer 4 and the oil/gas layer 6 maintain contact at the water-oil contact layer 5, where the water and oil exist in mixed form. Essentially, the acoustic devices 3 may be programmed to create any dynamic acoustic impact in any direction desired, based on the desired effects on well productivity and function.

Figure 2:
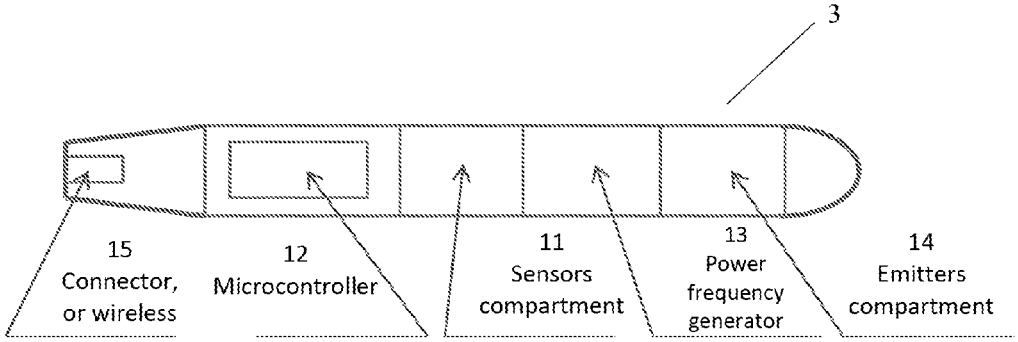
FIG. 2 shows an example of the various components of one embodiment of the acoustic device.

FIG. 2 discloses acoustic device 3 in more detail. The sensors compartment 11 measures conditions in the well (such as temperature of the formation, static and dynamic pressures in the collector zone, density and viscosity of the fluid) and transmits data to the microcontroller 12, which calculates the first parameters for well processing based on these data and geophysical information and transmits the data to the frequency generator 13. The generator 13 sends an acoustic ultrasonic pulse to the emitters compartment 14 and well processing is performed according to the diagram FIG. 6. The connector module 15 provides connection between the acoustic device 3 and a control unit on the ground (not shown). It can be wired or wireless.

To increase effectiveness and reduce duration of acoustic/ultrasonic processing of fluid well, a method of packet impacting the muddled zone of the fluid well is used. This alternates applying acoustic/ultrasonic pressure on the muddled zone and then dropping it off to zero. One processing cycle (cycle time—CT) consists of pressure time (PT) and relaxation time (RT), see FIG. 3. After this the operating cycle repeats again, pulsed acoustic impact leads to loosening of the muddled layer, removal of particulates muddling the layer, and more effective dispersal from the muddled zone.

Cycle configuration depends on the composition of the contamination and composition of the soil which surrounds the contamination zone. In the cycle, relaxation time (RT) does not have to equal the pressure time (PT) on the contaminated zone. Both the pressure time and relaxation time depend on the size of the contaminant particulates and their qualitative composition and is a function of parameters such as porosity (%), initial and current permeability ($\alpha$), density and viscosity of fluid in the well, saturation pressure ($\mu$), concentration and composition of salts, sulphur, wax, tar, asphalt, well pressure (p), formation temperature (t). These parameters, including formation temperature, static and dynamic pressures in the collector zone, fluid density and viscosity are measured by device sensors 11. The remaining parameters are installed based on geophysical studies performed or on corresponding sensor availability.

Figure 4:
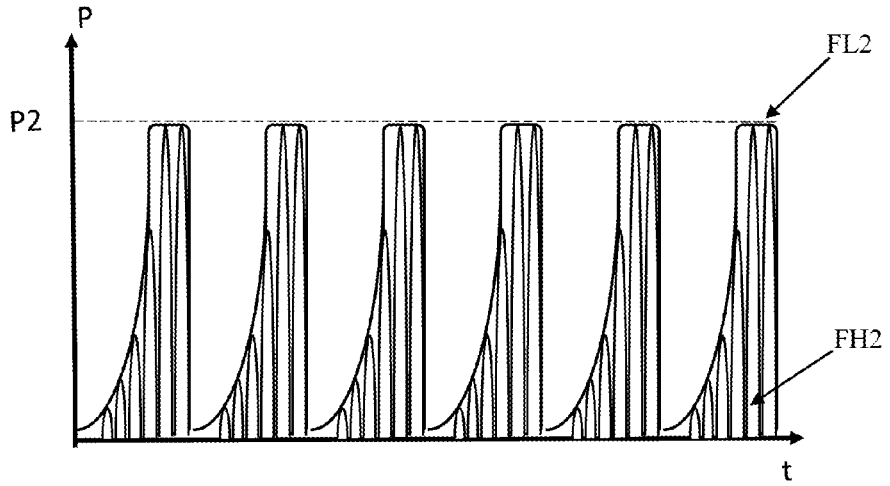
FIG. 4 shows another embodiment of acoustic treatment cycles by the device of the present invention.
Figure 5:
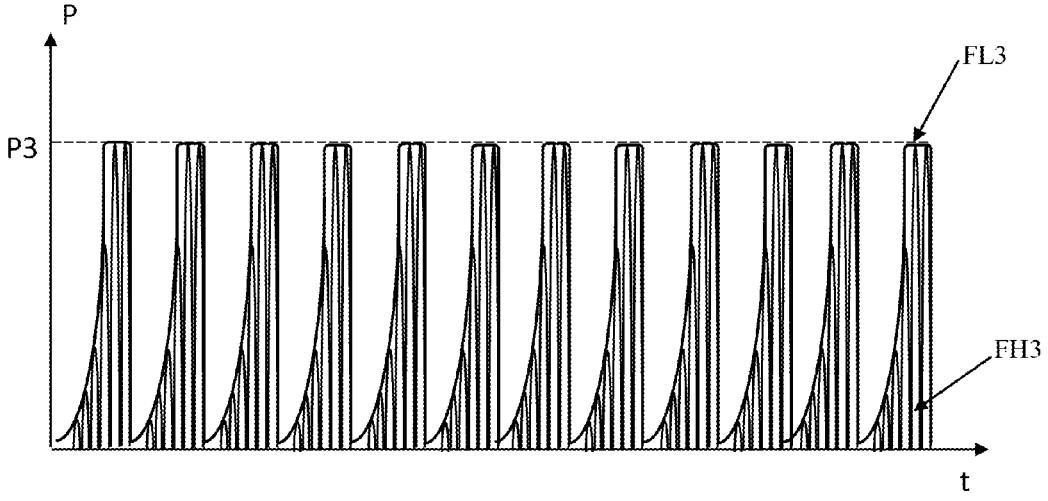
FIG. 5 shows yet another embodiment of acoustic treatment cycles by the device of the present invention.

Due to the heterogeneity of the muddled zone and irregular particulates (from 10 nm to 1 mm) comprising the muddled layer, the most critical parameters are size of particulates contaminating the bottom hole zone and collector zone, therefore acoustic/ultrasonic processing occurs in three stages at different frequencies. The cycle frequency FL1 of the first stage lies in the range from 0.5 Hz to 4 Hz with packet frequency FH1 in the range from 4 kHz to 7 kHz (see FIG. 3). Second stage—cycle frequency ranges from 4 Hz to 10 Hz with packet frequency ranging from 7 kHz to 14 kHz (see FIG. 4). Third stage—cycle frequency ranges between 14 kHz to 18 kHz with packet frequency ranging from 10 Hz to 100 Hz (shown in FIG. 5). Emission power (P1, P2 and P3) varies from 0 to 5 kW or greater and depends on the condition of the well and bottom hole zone. In one embodiment, the emission power varies during the treatment with the same cycle frequency.

In one embodiment the treatment frequency is selected to achieve a resonant oscillation in a perforated well zone.

Growth of a packet front 21 should occur along an exponential or other growth curve to prevent a water hammer, which can lead not to the structural breakdown of contamination, but to flattening (like clay) of the front wall of the muddled layer, adjacent to the source of the emission. In another embodiment, the front growth is along semi-parabola.

Relaxation time (RT) in the cycle is determined based on the input parameters and can be equal to the processing time in the cycle, greater than, less than the processing time or equal to 0 (in the cycle) depending on the input parameters and formation parameters.

Figure 6:
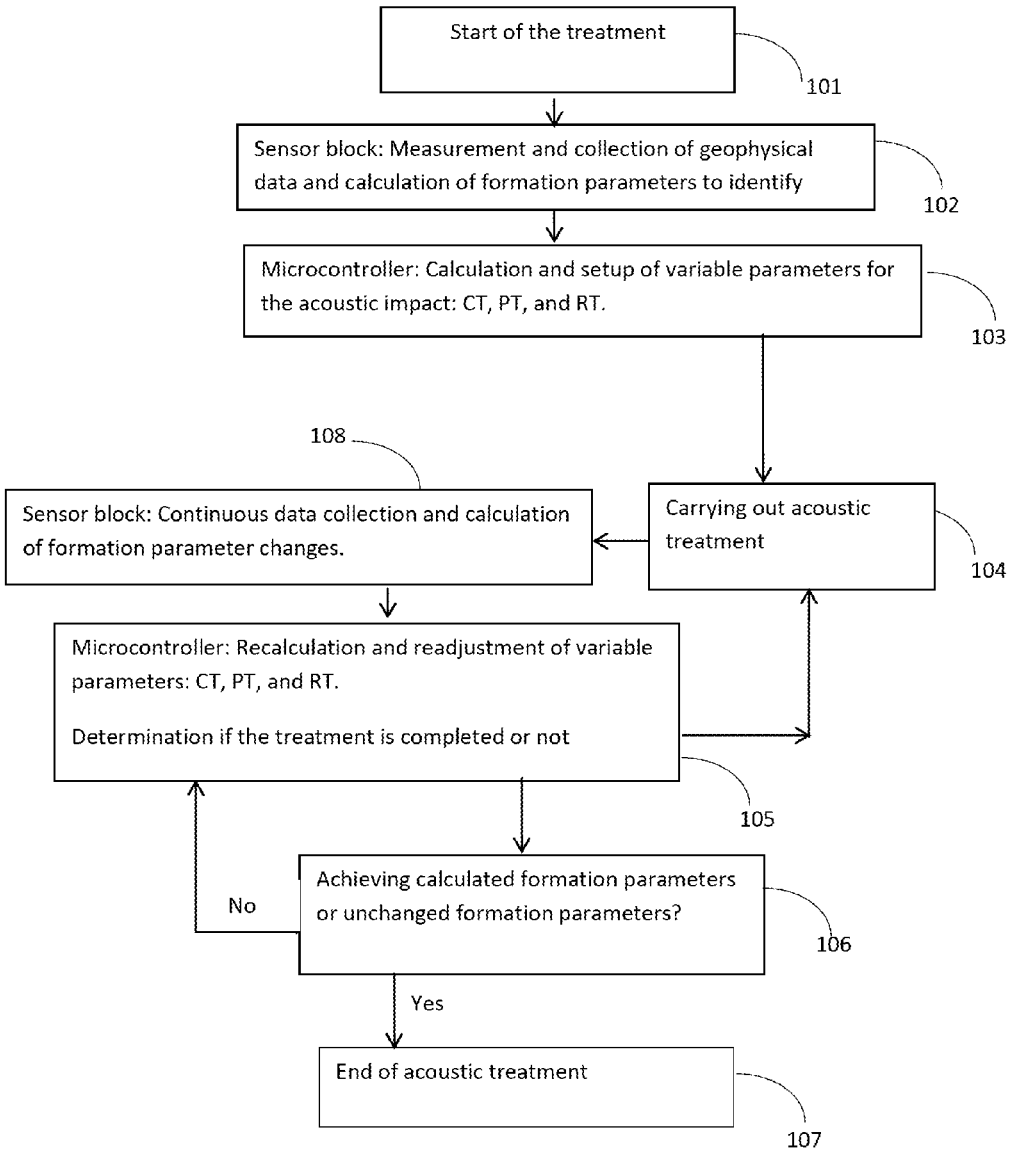
FIG. 6 is a flowchart detailing one embodiment of the method of the present invention.

FIG. 6 shows a operation flow chart from the start 101, to the end 107, for one embodiment of the present invention:

1. Sensor block performs collection of geophysical data to meet initial criteria for required treatment and calculation of formation parameters to identify those formation parts, or areas, which are decreasing productivity (for example, based on a chart of the speed of production decline; a higher speed of production decline would suggest a need for treatment) 102;

2. Microcontroller block performs calculation and setup of variable parameters CT, PT, and RT 103. Using the input parameters and criteria for acoustic impact optimization, the initial equipment setup is determined for the given resource deposit conditions;

3. Carrying out acoustic treatment 104;

4. Sensor block performs continuous data collection and calculation of formation parameter changes as acoustic treatment continues 108;

5. Microcontroller block performs determination whether the treatment and setup parameters are either achieving the desired formation parameters or maintaining formation parameters 105;

6. Microcontroller block performs recalculating and adjusting (i.e. optimizing) of the variable setup parameters selected for acoustic treatment when desired formation parameters are not achieved or maintained 105 (feedback loop); and 8. Ending or continuing with acoustic treatment when desired formation parameters are achieved or maintained 107.

Treatment (i.e. acoustic processing) of the wells (or key well areas) increases productivity and decreases the water component (water cut) of entire oil or gas fields, affecting even those wells which are not directly treated.

The present invention may be used to increase formation productivity by improving hydrodynamic connection(s) between wells by restoring and optimizing the filtration characteristics of the bottom-hole zone of a well or well system. One of the embodiments of the present invention includes placement of acoustic devices in two or more wells simultaneously. The method comprises causing a synergistic effect from acoustic fields (at least two) on the well bore zones of at least an adjacent pair of injection and/or production wells or any group of connected wells. The effect of the acoustic fields is apparent on site (i.e. near the acoustic device creating the effect) as well as throughout an entire formation or well field. "Adjacent pair," as used herein, is defined as a pair of any type of well (i.e., one production well with one injection well, two production wells, two injection wells, and any combination thereof). The term "pair" does not limit, in any way, the number of wells which may be hydrodynamically connected and acoustically processed, as described herein. The setup may include 3 total wells, wherein one is an injection well and two are production wells, or wherein one is a production well and two are injection wells (or 4, 5, 6 total wells, etc.). The only constraint on the combinations of types and amounts of wells is on the physical possibility for the existence of hydrodynamic connections between actual wells (i.e., any hydrodynamically connected well system improves by employing the present invention).

Devices employed by the method of the present invention may be wired, wireless, or any other. The devices used for acoustic processing (at least two: one for positioning within each of the at least two wells) are further selected based on the analysis of the hydrodynamic relationship between injection and production for specific well groups and for the formation as a whole. Wells having a hydrodynamic relationship are connected via channels and/or capillaries located beneath the ground. Any change in the parameters of a well with a hydrodynamic connection to another well will, in turn, affect the parameters of other wells via the hydrodynamic connection. For example, if after acoustic treatment, an injection well experiences increased hydrodynamic pressure, this will increase production in any hydro-dynamically connected production well(s). The feedback loop will record information regarding production and the formation and changes acoustic treatment parameters, allowing for optimization of process parameters for best production results.

Acoustic processing (i.e., a dynamic acoustic effect, achieved by one or more acoustic devices positioned within the well) may begin simultaneously in both wells of a hydrodynamically connected group of wells. Alternatively, those wells selected from the injection group may first be processed acoustically to redistribute the injection profile of the displacing agent. And subsequently, the corresponding production wells are processed acoustically with the aim of changing filtration stream directions in adjacent formation zones.

Figure 7:
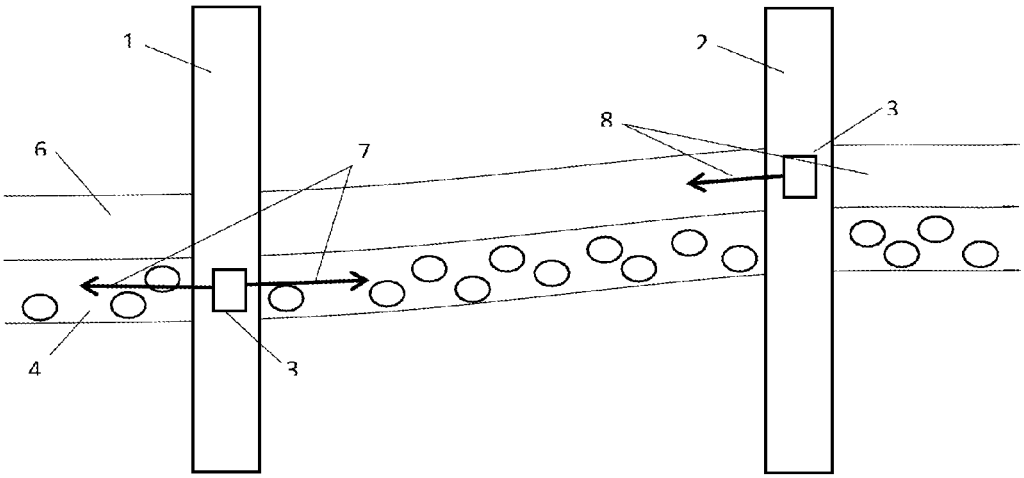
FIG. 7 shows a side cross-sectional view of the embodiment with two wells.

FIG. 7 shows two wells 1 and 2 with acoustic devices 3 placed within. Acoustic device may perform an impact on one or multiple layers. Acoustic devices placed in different wells may impact the same or different layers. FIG. 7 shows the acoustic device in well 1 impacting water layer 4 and the acoustic device in well 2 impacting oil layer 6.

Well perforation intervals are processed acoustically point-by-point within each well and selectively in zones of elevated filtration resistance, which may be determined, for example, by preliminary geophysical investigations. Processing parameters may be corrected on the basis of data obtained and analyzed during the initial stages of processing as well as any later stage, if parameters change, or as otherwise needed.

In order to choose acoustic impact parameters (FL1, FL2, FL3, FH1, FH2, FH3, P1, P2, P3), it is necessary to evaluate the geological parameters of the formation. The formation parameters monitored include but are not limited to the following inputs/information, collected during the well drilling process, measured by geophysical instruments, and/or calculated based on geophysical research and measurements:

1. Porosity (measured in percentage, based on geophysical information);
2. Permeability (measured in mD (mDarcy);
3. Bottom-hole pressure (direct measurement, in atm);
4. Formation pressure in well zones (direct measurement, in atm);
5. Downhole temperature (direct measurement, in C° or F°);
6. Clayiness (i.e., clay percentage) (measured in percentage, based on geophysical information);
7. Current oil saturation of rock formation (measured in percentage, based on geophysical information);
8. Stratum pressure (direct measurement, in atm); and
9. Dynamic viscosity under current conditions (measured in mPa's).

Figure 3:
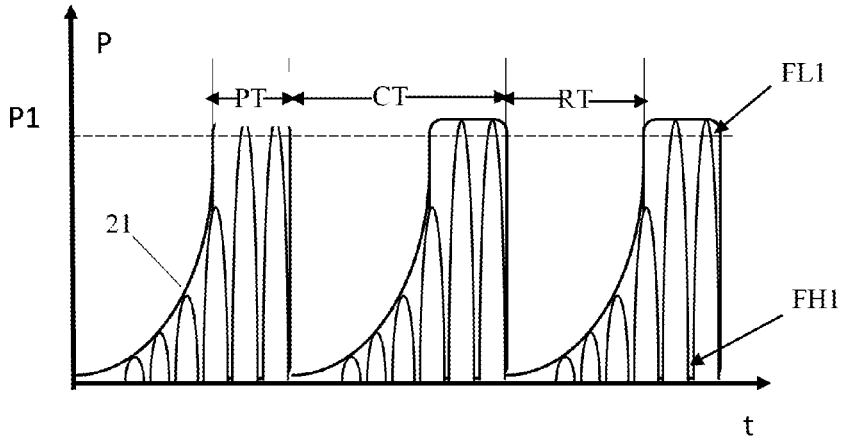
FIG. 3 shows one embodiment of acoustic treatment cycles by the device of the present invention.

The method comprises continuous or periodic synergistic formation treatment with process repetition to achieve and maintain an improved or stabilized water cut during production, increased oil production due to changes in input parameters, and, as a result, a greater coefficient of oil or gas production (FIG. 3). The present method leads to increased recoverable reserves of oil or gas in a formation.

The present invention also discloses a methodical technological system designed based on an effect on individual wells, but configured to work not just on individual wells but for the whole formation.

The disclosed system and method accomplish the following objectives:

1. Regulating the process of developing the resource deposit by controlling the discharge front.
2. Identifying formation parts with poor filtration and high residual oil or gas reserves, and including those parts in the filtration process.
3. Identifying and including poorly-draining formations in the filtration process.
4. Continuously controlling the parameters of the acoustic impact process as well as changing parameters of the fluid in the bottom-hole zone while recording data regarding the changing parameters of the fluid and/or formation into a database for further analysis.
5. Automatically or manually changing the acoustic impact parameters on the basis of the above-mentioned recorded data, with the aim of optimizing the acoustic impact.

The proposed invention is unique for the following reasons. Acoustic treatment of an individual well results in changes to the filtration properties of its bottom zone. In the case of treating a single well, depending on the specified objective, the result will be either redistribution of the filtration profile, increased injection/flow rate, or both simultaneously. The stated effects permit an increase in oil production.

However, in the case of separate or individual processing of spatially isolated and hydrodynamically isolated wells, the effect from the separate or individual impact on the formation as a whole may not be strong enough. That's why in the present patent application we describe a combined impact of two or more acoustic devices. The impact on the specific area of the formation, however, can lead to an increased oil or gas production rate and as a result, increased recoverable reserves from that particular area. The present invention provides a method for impacting various parts of a formation, or the formation as a whole, rather than just one specific area, thus having applicability in treating hydrodynamically connected well systems.

The present invention provides highly selective impacts, low costs, ease-of-use, and complete environmental safety. The present invention is free from the aforementioned disadvantages of known methods for impacting formations. The invention may additionally be implemented in conjunction with known chemical methods in order to raise their effectiveness by increasing reagent penetration depth into a formation.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

The invention claimed is:

1. A method for restoring, maintaining, or increasing oil or gas productivity of a geological formation or reducing a water cut in the formation, comprising:

positioning an acoustic device in a well located within the geological formation, performing an acoustic treatment impacting a muddled zone in cycles by a series of acoustic packets thus periodically applying acoustic/ultrasonic pressure P on the muddled zone and then dropping it off to zero, wherein a cycle time CT consists of a pressure time PT and a relaxation time RT, and a ratio PT:RT; a cycle frequency and a packet frequency are selected depending on formation parameters obtained by sensors positioned on the acoustic device;

repeating the treatment until the well productivity is restored.

2. The method according to claim 1, further comprising depending on formation parameters based on known geophysical studies.

3. The method according to claim 2, wherein the parameters include concentration and composition of salts, Sulphur, wax, tar, or asphalt.

4. The method according to claim 2, wherein the parameters include porosity (%); and initial and current permeability $\alpha$.

5. The method according to claim 2, wherein the parameters include density and viscosity of a fluid in the well.

6. The method according to claim 2, wherein the parameters include a formation temperature and static and dynamic pressures in a collector zone.

7. The method according to claim 1, wherein the cycle frequency FL1 is in the range from 0.5 Hz to 4 Hz with the packet frequency FH1 in the range from 4 kHz to 7 kHz.

8. The method according to claim 1, wherein the cycle frequency FL2 is in the range from 4 Hz to 10 Hz with the packet frequency FH2 in the range from 7 kHz to 14 kHz.

9. The method according to claim 1, wherein the cycle frequency FL3 is in the range from 14 kHz to 18 kHz with the packet frequency FH3 in the range from 10 Hz to 100 Hz.

10. The method according to claim 1, wherein growth of a packet front occurs along an exponential curve.

11. The method according to claim 1, wherein growth of a packet front occurs along a semi-parabola.

12. The method according to claim 1, wherein at least one acoustic device is a wireless acoustic device.

13. The method according to claim 1, further comprising changing a power of the treatment , a cycle frequency and a packet frequency during the treatment depending on a changing data from the sensors regarding the formation parameters.

14. The method according to claim 13, wherein at least two types of impact are used during the treatment: a first one with the cycle frequency FL1 is in the range from 0.5 Hz to 4 Hz with the packet frequency FH1 in the range from 4 kHz to 7 kHz and a second one with the cycle frequency FL2 is in the range from 4 Hz to 10 Hz with the packet frequency FH2 in the range from 7 kHz to 14 kHz.

15. The method according to claim 14, further comprising using a third type of impact with the cycle frequency FL3 is in the range from 14 kHz to 18 kHz with the packet frequency FH3 in the range from 10 Hz to 100 Hz.

16. The method according to claim 15, wherein an emission power of treatment is different for all three types of treatment.

17. The method according to claim 16, wherein the emission power varies from 0 to 5 kW.

18. The method according to claim 17, wherein the emission power changes during the treatment with the particular cycle frequency, either FL1 or FL2 or FL3.

19. The method according to claim 1, wherein the cycle frequency or the packet frequency is selected to achieve a resonant oscillation in a perforated well zone.

20. The method according to claim 1, wherein a treatment parameters are set up by a microcontroller located on the acoustic device.

* * * * *